US006735835B2

(12) United States Patent
Wong

(10) Patent No.: US 6,735,835 B2
(45) Date of Patent: May 18, 2004

(54) METHOD AND APPARATUS FOR MANUFACTURING NON-WOVEN FABRICS

(76) Inventor: Kong Foo Wong, 89 Jalan 5/109 C, Taman Sri Seputih, Off Lorong Seputih, 5800 Kuala Lumpur (MY)

( * ) Notice: Subject to any disclaimer, the term of this patent is extended or adjusted under 35 U.S.C. 154(b) by 184 days.

(21) Appl. No.: 09/922,524

(22) Filed: Aug. 3, 2001

(65) Prior Publication Data

US 2002/0124367 A1 Sep. 12, 2002

(30) Foreign Application Priority Data

Aug. 18, 2000 (MY) ..... PI 2000 3791

(51) Int. Cl.[7] ..... D04H 5/02; D04H 5/08

(52) U.S. Cl. ..... 28/107; 28/102; 28/111

(58) Field of Search ..... 28/101, 102, 107, 28/111, 112, 108, 109, 110, 113, 114, 115, 103; 19/163

(56) References Cited

U.S. PATENT DOCUMENTS 2,381,184 A * 8/1945 Ripley ..... 28/107
2,962,080 A * 11/1960 Hirsch ..... 28/102
3,257,259 A * 6/1966 Law ..... 28/107
3,337,387 A * 8/1967 Owen ..... 28/107
3,523,059 A * 8/1970 Coates ..... 28/112
3,576,687 A * 4/1971 Parlin ..... 28/107
3,689,349 A * 9/1972 Burger ..... 28/101
3,756,893 A * 9/1973 Smith ..... 28/107
3,765,989 A * 10/1973 Burger ..... 28/102
3,849,223 A * 11/1974 Kent ..... 28/112
3,920,511 A * 11/1975 Grieves et al. ..... 28/107
4,183,985 A * 1/1980 Lemieux ..... 28/111
5,242,520 A * 9/1993 Carrier ..... 28/102

* cited by examiner

*Primary Examiner*—Amy B. Vanatta
(74) *Attorney, Agent, or Firm*—Ipsolon LLP

(57) ABSTRACT

A method of manufacturing a non-woven fabric, comprises: opening and mixing different input fibres to form a uniform fibre mixture having predetermined proportions of the different input fibres; carding the fibre mixture to form a uniform web of predetermined thickness travelling in a first direction; laying onto the web high tenacity yarns which extend in the first direction and are spaced apart transversely of the first direction; depositing fixed lengths of the web in alternating fashion on a conveyor travelling in a second direction transverse to tile first direction to form on the conveyor a mat consisting of overlapping lengths of the web; and needle-punching the mat to form the non-woven fabric. Apparatus for performing this method of manufacture is also provided.

9 Claims, 2 Drawing Sheets

METHOD AND APPARATUS FOR MANUFACTURING NON-WOVEN FABRICS

THIS INVENTION relates to a method of and apparatus for manufacturing non-woven fabrics and, in particular, geotextiles.

Non-woven geotextiles are sheet materials which are constructed from synthetic fibres, made of polypropylene and/or other synthetic materials, and are employed in civil engineering applications, such as land drainage, filtration and reinforcement.

In a known production line for manufacturing non-woven geotextiles, quantities of different input fibres to be incorporated in the non-woven product in predetermined proportions are first weighed out by an electronically controlled weighing machine. The constituent input fibres are then subjected to an initial opening and mixing operation in a main opening machine, the opened and mixed fibres then being passed into a mixing and blending bin in which the fibre-to-fibre mixing is improved to optimise the uniformity of the mixture of input fibres. The output of the mixing and blending bin next enters a fine opening machine which ensures that the input fibres are fully opened and blended into a homogeneous mixture to ensure that the finished product has a consistent density. The input fibre mixture emerging from the fine opening machine is transferred to a hopper which includes a vibrating system accurately controlled by photosensitive detectors to deliver a continuous flow of the fibre mixture at a constant flow rate into a carding machine which serves to comb and straighten the mixture of input fibres to form a carded web of desired thickness. The carded web delivered by the carding machine is then deposited as overlapping layers onto a conveyor travelling transversely of the length direction of the carded web by a cross-lapping machine to form a layered web. The conveyor transports the layered web to a series of needle-punching machines which securely interlock and entangle the fibres of the overlapping layers to form a non-woven geotextile strip which is wound into a roll of the required size by a winding machine after leaving the last needle-punching machine.

In the described process, the production line up to the cross-lapping machine is orientated in the length direction of the product. Consequently, the carded web leaving the carding machine inevitably has weaker strength properties in the length direction than in the width direction. Since the length direction then becomes the width direction in the layered web as a result of the action of the cross-lapping machine, the result is that the strength of the finished geotextile product is impaired to some degree in the width direction. Whilst the known process is capable of producing geotextile products having a strength in the width direction which is adequate for many purposes, there are also many circumstances in which a geotextile product having greater strength in the width direction would be desirable.

It is accordingly an object of the present invention to provide a method of and apparatus for manufacturing a length of non-woven fabric which provide the fabric with enhanced the strength in the width direction.

Accordingly, in one aspect, the present invention provides a method of manufacturing a non-woven fabric, comprising: opening and mixing different input fibres to form a uniform fibre mixture having predetermined proportions of the different input fibres; carding the fibre mixture to form a uniform web of predetermined thickness travelling in a first direction; depositing fixed lengths of the web in alternating fashion on a conveyor travelling in a second direction transverse to the first direction to form on the conveyor a mat consisting of overlapping lengths of the web; and needle-punching the mat to form the non-woven fabric; which method is characterised by laying high tenacity yarns onto the web prior to depositing the lengths of the web on the conveyor to form the mat, the yarns extending in the first direction and being spaced apart transversely of the first direction.

Conveniently, the high tenacity yarns are dropped onto the web as the web leaves the carding machine.

In one method embodying the invention, which strengthens the non-woven fabric both in the second direction and transversely of the second direction, each high tenacity yarn is laid on the web so that the yarn both extends along the first direction and undulates transversely of the first direction.

In carrying out a method embodying the invention, the spacing of the yarns transversely of the first direction may be selected to achieve a desired increase in the strength of the non-woven fabric transversely of the second direction.

Preferably, the high tenacity yarns comprise yarns made from one or more materials selected from the group consisting of polyester, aramide and glass fibre.

In another aspect the invention provides apparatus for manufacturing a non-woven fabric, comprising: an opening and mixing arrangement for opening and mixing input fibres to form a uniform fibre mixture having predetermined proportions of different input fibres; a carding machine for carding the fibre mixture to form a uniform web of predetermined thickness travelling in a first direction; a cross-lapping machine for depositing lengths of the web in alternating fashion onto a conveyor travelling in a second direction transverse to the first direction to form on the conveyor a mat consisting of overlapping lengths of the web; and needle-punching the mat to form the non-woven fabric; which apparatus is characterised by yarn applying means for laying high tenacity yarns onto the initial web prior to depositing the lengths of the web onto the conveyor, the yarns extending in the first direction and being spaced apart transversely of the first direction.

Conveniently, the yam applying means drops the high tenacity yarns onto the web as it leaves the carding machine.

In one apparatus embodying the invention, the yam applying means lays each high tenacity yam on the web so that the yam both extends along the first direction and undulates transversely of the first direction, thereby strengthening the non-woven fabric both in the second direction and in transversely of the second direction.

Advantageously, the yarn applying means is adjustable to vary the spacing of the high tenacity yarns and thereby vary the strength of the resulting non-woven fabric.

Preferably, the high tenacity yarns are made from one or more materials selected from the group consisting of polyester, aramide and glass fibre.

In a further aspect, the invention provides a non-woven fabric made by the method of the present invention.

In order that the invention may be more readily understood, embodiments thereof will now be described, by way of example, with reference to the accompanying drawings, in which.

Figure 1:
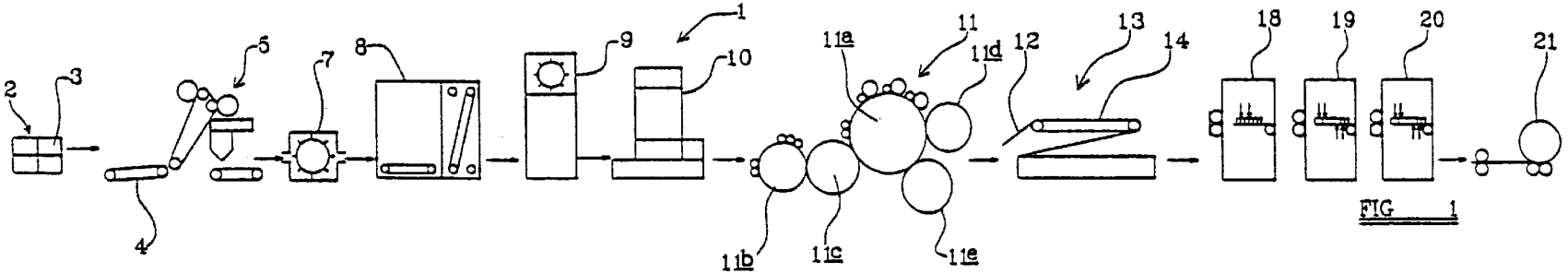
FIG. 1 is a diagrammatic view of a known apparatus for manufacturing non-woven geotextiles.

Referring initially to FIG. 1, a known production line 1 for manufacturing non-woven geotextiles comprises an input station 2 at which bales 3 of different input fibres are unpacked. The fibres are loaded onto an input conveyor 4 of an electronically controlled weighing machine 5 which weighs out a required amount of each input fibre in accordance with the desired proportions of the different fibres in the geotextile to be manufactured.

An output conveyor 6 of the weighing machine 5 transports the weighed quantities of input fibres to a main opening machine 7 which performs a first mixing and opening process on the input fibres and delivers the resulting fibre mixture to a mixing and blending bin 8. From the mixing and blending bin 8 the fibre mixture passes to a fine opening machine 9 which carries out a final opening process.

The fibre mixture delivered by the fine opening machine goes into a hopper 10 having a vibratory feed system which is controlled by two sets of photosensitive detectors so to continuously feed a constant flow of the fibre mixture to a carding machine 11 which comprises a main cylinder 11*a*, a worker roll 11*b*, stripper rolls 11*c* and 11*d* and a doffer roll 11*e*. The surfaces of the main cylinder and the other rolls are covered with metallic wires and are rotated at different speeds about respective horizontal axes. The fibre mixture is carded and combed by the carding machine 11 to form a carded web 12 which is transported in a first direction to a cross-lapping machine 13 having an upper conveyor 14 travelling in the first direction. The upper conveyor 14 is actuated in a reciprocating manner to lay alternating and overlapping lengths 15 (see FIG. 2) of the web 12 onto a lower conveyor 16 travelling in a second direction transverse to the first direction. The resulting layered mat 17 (FIG. 2) is fed to a series of needle-punching machines 18, 19 and 20 to produce the finished geotextile which is then formed into a roll for storage and transport by a winding machine 21.

In operation of the described production line, the desired quantities of the different input fibres from which the geotextile is to made are set on the weighing machine 5 and the weighed quantities of fibres are passed to the main opening machine 7 which serves to initially open and mix the different input fibres received from the weighing machine 5. The mixing of the input fibres in the fibre mixture emerging from the main opening machine 7 is further improved by passage through the mixing and blending bin 8 which thereby optimises the uniformity of the finished product. Full opening of the input fibres in the homogeneous mixture delivered by the mixing and blending bin 8 is ensured by the final opening process performed by the fine opening machine 9.

The fully mixed and opened mixture of input fibres from the fine opening machine 9 is delivered to the hopper 10 and is fed to the carding machine 11 at a constant flow rate by the controlled feed system of the hopper 10. As they travel through the carding machine 11, the fibres are combed and straightened in the direction of travel. The carding process converts the mixture of fibres into a uniform web, the thickness of which is controlled by the difference in the rotational speeds of the main cylinder and other rolls. By operation of the main cylinder and the other rolls, the degree of fibre orientation can be controlled and maintained.

The cross-lapping machine 13 receives the web from the carding machine and operates to deposit overlapping lengths of the web on the lower conveyor 16 to form the layered mat which is transported by the lower conveyor to the input of the series of needle-punching machines 18, 19 and 20 which interlock and entangle the fibres of the layered mat to form the finished non-woven fabric which is then formed into a roll for storage and transport by the winding machine 21.

Figure 2:
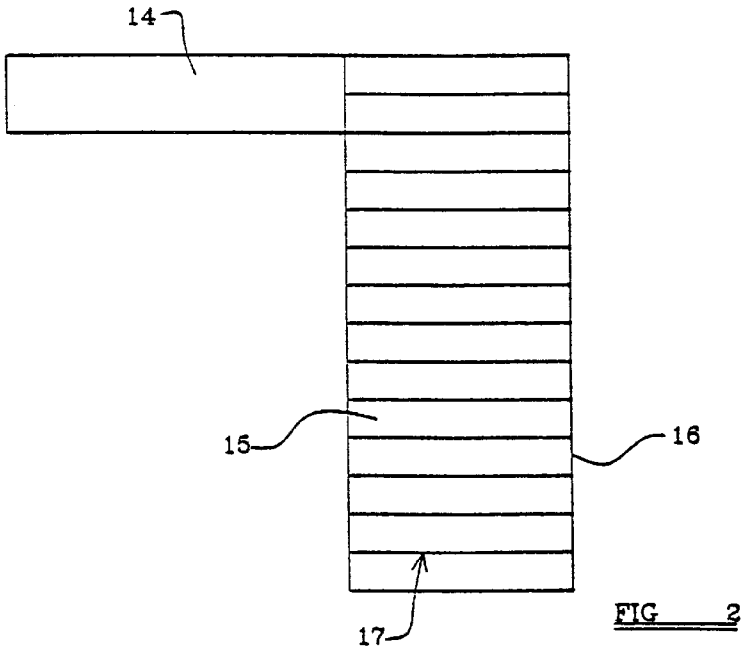
FIG. 2 is a schematic plan view, showing the cross-lapping of a carded non-woven web by the known apparatus to form a layered mat which is subsequently needle-punched to form the finished non-woven fabric.
Figure 3:
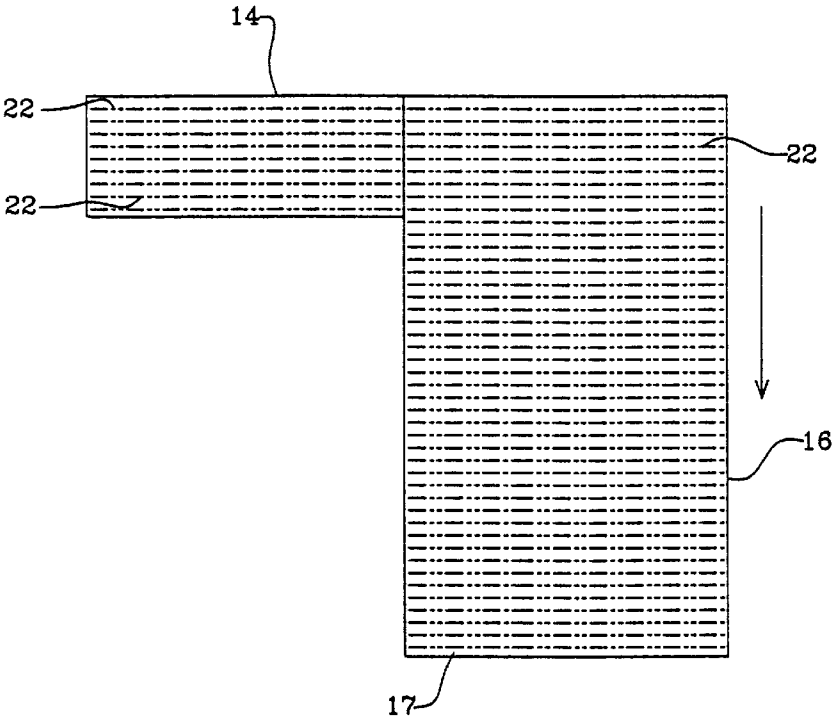
FIG. 3 is a schematic plan view, illustrating the addition of high tenacity yarns to the carded web prior to the cross-lapping process in accordance with a first embodiment of the invention.

FIG. 3 illustrates one embodiment of the present invention as applied to the production line described with reference to FIGS. 1 and 2. In accordance with this embodiment of the invention, as the web 12 proceeds from the carding machine 11 to the cross-lapping machine 13 a plurality of high tenacity yarns 22 are laid onto the surface of the web. The high tenacity yarns are made, for example, from polyester, aramid or glass fibre and are laid down in spaced apart relationship transversely of the first direction, i.e. the direction of travel of the upper conveyor 14. The resulting layered mat including the yarns 22 then enters the series of needle-punching machines 18, 19 and 20 which mechanically bond the non-woven fibres into a stable fabric, while at the same time bonding the strengthening yarns 22 in position within the non-woven fabric. The yarns 22 are significantly stronger than the polypropylene or other synthetic input fibres that are used to construct the web 12 and when laid as shown in FIG. 2 they significantly strengthen the finished product in the width direction. By adjusting the number of individual yarns 22 and their spacing, within limits any desired increase in strength can be achieved.

Figure 4:
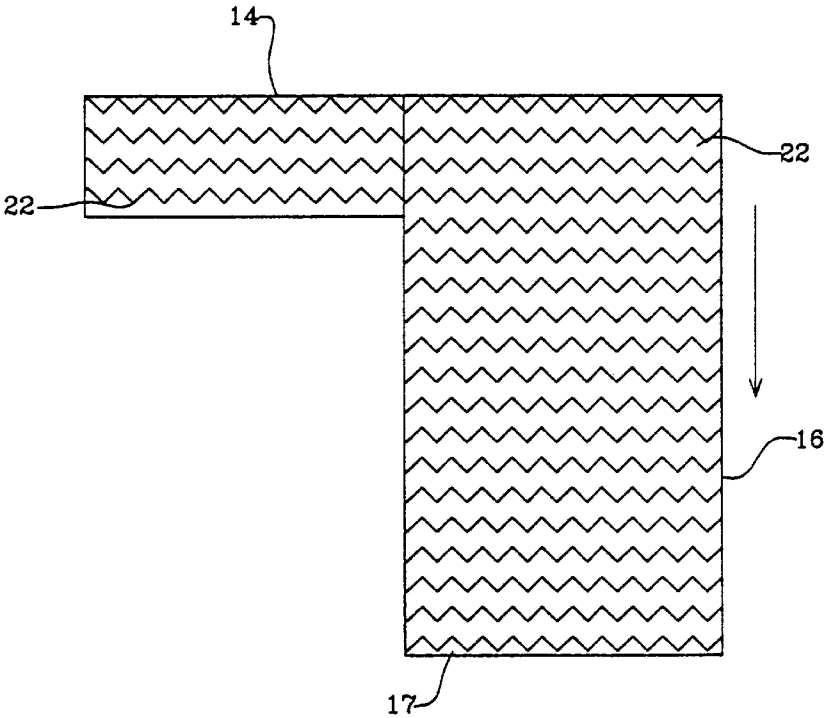
FIG. 4 is a schematic plan view, illustrating the addition of high tenacity yarns to the initial web prior to the cross-lapping process in accordance with a second embodiment of the invention.

FIG. 4 illustrates a second embodiment of the invention, in which the yarns 22 are dropped from a stationary position above the web as it emerges from the carding machine and the dropping mechanism is vibrated to cause the yarns to adopt an undulating configuration having a zig-zag shape transversely of the first direction. This means that, in addition to extending across the layered mat, the yarns 22 also have portions extending in the length direction, so that the finished product emerging from the needle-punching machine is also strengthened in the length to some extent, although to a lesser degree than in the width direction.

In the present specification "comprise" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A method of manufacturing a non-woven fabric, comprising:

opening and mixing different input fibres to form a uniform fibre mixture having predetermined proportions of the different input fibres;

carding the fibre mixture to form a uniform web of predetermined thickness traveling in a first direction;

depositing fixed lengths of the web in alternating fashion on a conveyor traveling in a second direction transverse to the first direction to form on the conveyor a mat having overlapping lengths of the web;

and needle-punching the mat to form the non-woven fabric; which method is characterized by laying high tenacity yarns onto the web prior to depositing the lengths of the web on the conveyor to form the mat, each yarn laid on the web so that the yarn extends in the first direction and is spaced apart and undulates transversely of the first direction.

2. A method according to claim 1, in which the high tenacity yarns are dropped onto the web as the web leaves the carding machine.

3. A method according to claim 1, in which the spacing of the yarns transversely of the first direction is selected to achieve a desired increase in the strength of the non-woven fabric transversely of the second direction.

4. A method according to claim 1, in which the high tenacity yarns comprise yarns made from one or more materials selected from the group consisting of polyester, aramide and glass fibre.

5. An apparatus for manufacturing a non-woven fabric, comprising:

an opening and mixing arrangement for opening and mixing input fibres to form a uniform fibre mixture having predetermined proportions of different input fibres;

a carding machine for carding the fibre mixture to form a uniform web of predetermined thickness traveling in a first direction;

a cross-lapping machine for depositing lengths of the web in alternating fashion onto a conveyor traveling in a second direction transverse to the first direction to form on the conveyor a mat having overlapping lengths of the web; and at least one needle punching machine for needle punching the mat to form the non-woven fabric; which apparatus is characterized by yarn applying means for laying high tenacity yarns onto the web prior to depositing the lengths of the web onto the conveyor, each yarn laid on the web so that the yarn extends in the first direction and is spaced apart and undulates transversely of the first direction.

6. An apparatus according to claim, 5, in which the yarn applying means drops the high tenacity yarns onto the web as it leaves the carding machine.

7. An apparatus according claim 5, in which the yarn applying means is adjustable to vary the spacing of the high tenacity yarns and thereby vary the strength of the resulting non-woven fabric.

8. An apparatus according to claim 5, in which the yarns are made from one or more materials selected from the group consisting of polyester, aramide and glass fibre.

9. A non-woven fabric made by the method of claim 1.

* * * * *